US005842935A

United States Patent [19]

Nelson

[11] Patent Number: 5,842,935

[45] Date of Patent: Dec. 1, 1998

[54] GOLF PUTTER HEAD WITH LOW DENSITY INSERT

[75] Inventor: Michael J. Nelson, Phoenix, Ariz.

[73] Assignee: Karsten Manufacturing Corporation, Phoenix, Ariz.

[21] Appl. No.: 896,151

[22] Filed: Jul. 17, 1997

[51] Int. Cl.[6] ..... A63B 53/04

[52] U.S. Cl. ..... 473/342; 473/341

[58] Field of Search ..... 473/305, 313, 473/325, 327, 328, 329, 330, 332, 334, 335, 336, 337, 338, 339, 340, 341, 342, 345, 346, 347, 349, 350

[56] References Cited

U.S. PATENT DOCUMENTS

| | | | |
|---|---|---|---|
| D. 240,751 | 7/1976 | Taylor . | |
| D. 277,692 | 2/1985 | MacDougall | D21/219 |
| D. 298,767 | 11/1988 | Szczepanski | D21/219 |
| D. 333,332 | 2/1993 | McCabe | D21/219 |
| D. 352,984 | 11/1994 | Helmstetter | D21/219 |
| D. 356,356 | 3/1995 | Jacobs | D21/219 |
| D. 366,919 | 2/1996 | Jacobs | D21/219 |
| D. 379,484 | 5/1997 | Solheim | D21/217 |
| D. 380,029 | 6/1997 | Anderson | D21/217 |
| 3,387,844 | 6/1968 | Shippee . | |
| 3,815,910 | 6/1974 | Raines . | |
| 3,843,122 | 10/1974 | Florian . | |
| 4,113,249 | 9/1978 | Beery . | |
| 4,156,526 | 5/1979 | Huggins . | |
| 4,199,144 | 4/1980 | Skelly . | |
| 4,569,524 | 2/1986 | Quijano | 473/342 |
| 4,679,792 | 7/1987 | Straza . | |
| 5,083,778 | 1/1992 | Douglass . | |
| 5,190,290 | 3/1993 | Take | 473/342 |
| 5,332,214 | 7/1994 | Tucker . | |
| 5,458,332 | 10/1995 | Fisher . | |
| 5,482,281 | 1/1996 | Anderson | 473/341 |
| 5,485,997 | 1/1996 | Schmidt . | |
| 5,676,606 | 10/1997 | Schaeffer et al. | 473/340 |

FOREIGN PATENT DOCUMENTS

| | | |
|---|---|---|
| 2124910 | 2/1984 | United Kingdom . |

*Primary Examiner*—Steven Wong
*Attorney, Agent, or Firm*—Darrell F. Marquette

[57] ABSTRACT

A golf putter head includes a low density insert disposed in a cavity formed in a body. The insert has a front face arranged for impacting a golf ball, and the body has a heel end portion, a toe end portion, a bottom portion and a back portion which define a generally horseshoe shaped mass that partially surrounds the insert. The heel end portion of the body includes a boss projecting therefrom toward the body toe end portion, and a bore located in the boss receives a lower end of a shaft. The insert is preferably formed of polyurethane with a Shore D hardness of 65. The volume of the insert is greater than the volume of the body while the weight of the insert is less than the weight of the body.

7 Claims, 2 Drawing Sheets

GOLF PUTTER HEAD WITH LOW DENSITY INSERT

BACKGROUND OF THE INVENTION

This invention relates generally to golf clubs and, in particular, to a golf putter head with a low density insert forming a face for striking a golf ball.

In recent years, there has been increasing popularity in golf putter heads having faces that incorporate inserts made of non-metallic material. Such inserts provide a "soft feel" when striking a golf ball with the putter head. Some golfers prefer this "soft feel" because they are convinced that it improves their putting accuracy. Distance and direction to an intended target may be easier to control with a putter having a head including a non-metallic face insert.

U.S. Pat. No. 3,387,844 to Shippee discloses a golf putter head having a hollow percussion chamber mounted in a recess forming a drum-like device with a resilient face for contacting golf balls. The resilient face is cushioned by air contained within the percussion chamber. The club head may be formed of metal, and the percussion chamber may be formed of plastic or wood.

A golf putter head disclosed in U.S. Pat. No. 3,843,122 to Florian has a core structure containing a lightweight wooden block disposed between a pair of metal castings. The core structure is contained within a plastic shell, and a plastic insert is attached to one side of the shell to form a face for striking a golf ball.

U.S. Pat. No. 4,113,249 to Beery discloses a golf putter head including a front face with a vibratory cover plate mounted on the front face covering a recess formed in the front face. The vibratory cover plate is preferably formed of flexible and resilient material such as plastic so that it cooperates with the recess to provide a resonating chamber in the putter head.

A putter head disclosed in U.S. Pat. No. 4,156,526 to Huggins et al has a block of resilient material pressed into a cavity defined by back, side and end walls of the head. The block has a striking surface, and it may be removed from the head to permit other blocks of different resiliency to be substituted therefor.

A putter head disclosed in U.S. Pat. No. 4,679,792 to Straza et al is provided with a face insert formed of a honeycomb cellular structure that has individual cells filled by resilient material such as epoxy resin. Outer exposed ends of the resilient material form a striking face.

U.S. Pat. No. 5,083,778 to Douglass discloses a golf putter head having a rigid body and a resilient laminated face insert formed of inner and outer layers of resilient material. The inner layer of the face insert has a hardness which is less than that of the outer layer of the face insert. Preferably, the outer layer has a hardness which is equal to or greater than the hardness of a golf ball.

U.S. Pat. No. 5,458,332 to Fisher discloses a putter head with an elastomeric pad insert that is formulated to effect a reproducible direct linear relationship between the rebound factor of the pad insert and the distance from the putter head to an intended target.

A putter head disclosed in U.S. Pat. No. 5,485,997 to Schmidt et al has a face plate insert formed of an elastomer, a synthetic resin or glass. The insert includes a medial portion that has a greater height than its opposite end portions.

SUMMARY OF THE INVENTION

The present invention provides a golf putter head comprising a body formed of a first material having a first density. The body has a cavity formed therein, and an insert is disposed in the cavity. The insert is formed of a second material having a second density that is substantially lower than the first density. Preferably, the second density is 6.5 to 8.5 times lower than the first density. Also, the insert has a volume that is greater than the volume of the body and a weight that is less than the weight of the body. The first material may be a metal such as steel, and the second material may be an elastomer such as polyurethane.

The body preferably includes a heel end portion, a toe end portion, a bottom portion and a back portion that comprise a generally horseshoe shaped mass partially surrounding the insert. The insert has a front face arranged for impact with a golf ball. The body heel end portion comprises a bore for receiving a lower end of a shaft. The bore may be located in a boss that projects from the heel end portion toward the toe end portion.

In the preferred embodiment of the putter head, the volume of the insert is more than 50% of the total volume of the putter head, and the weight of the insert is less than 50% of the total weight of the putter head.

DESCRIPTION OF THE PREFERRED EMBODIMENT

Figure 1:
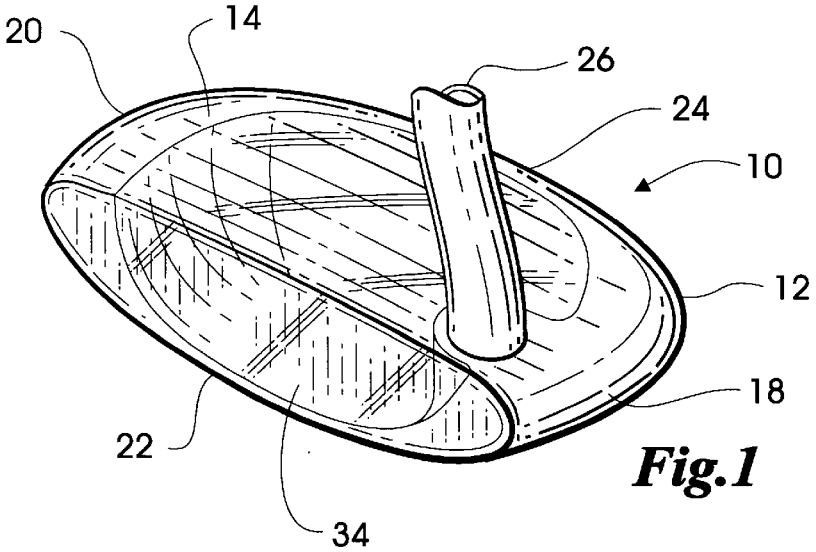
FIG. 1 is a perspective view of a golf putter head embodying the present invention with a portion of a shaft connected thereto.
Figure 1A:
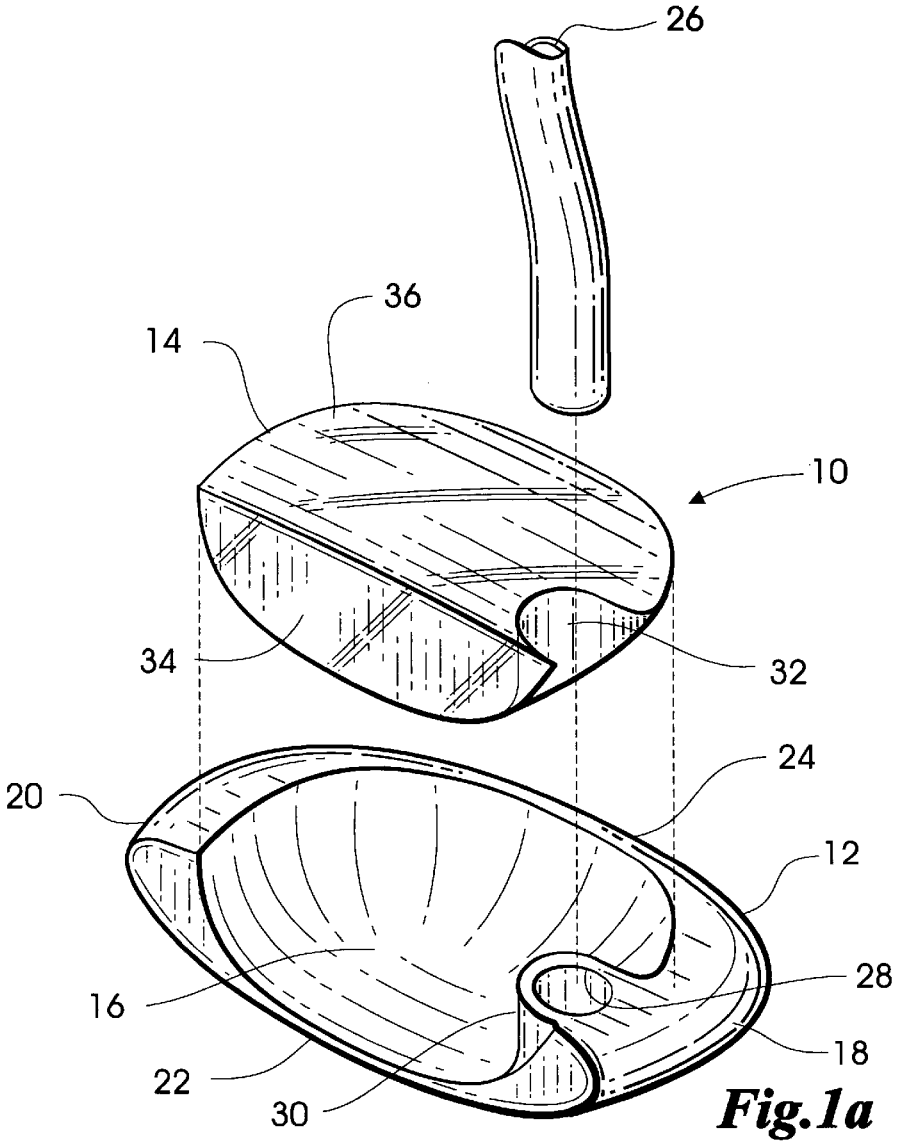
FIG. 1*a* is an exploded view of the golf putter head and shaft portion of FIG. 1.

Referring to FIGS. 1 and 1*a*, a golf putter head 10 according to the preferred embodiment of the present invention includes a body 12 and an insert 14 disposed in a cavity 16 provided in the body 12. The body 12 includes a heel end portion 18, a toe end portion 20, a bottom portion 22 and a back portion 24 that together define the cavity 16. A shaft 26 is received in a bore 28 formed in a boss 30 in the body heel end portion 18. The insert 14 has a recess 32 which receives the boss 30.

The body 12 is preferably formed of a suitable metal such as steel, and the insert 14 is preferably formed of an elastomeric material such as polyurethane with a Shore D hardness of 65. The insert 14 has a density that is 6.5 to 8.5 times lower than that of the body 12.

Figure 2:
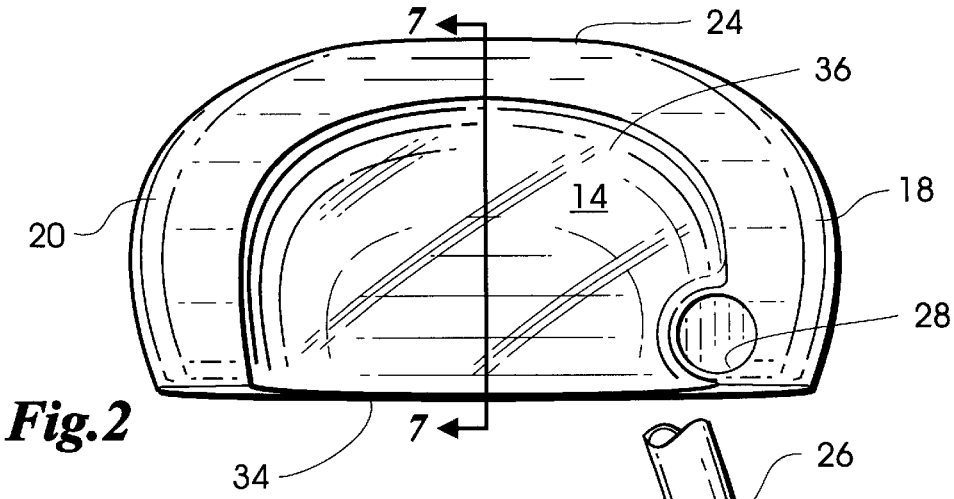
FIG. 2 is a top plan view of the golf putter head of FIG. 1 with the shaft portion removed.
Figure 3:
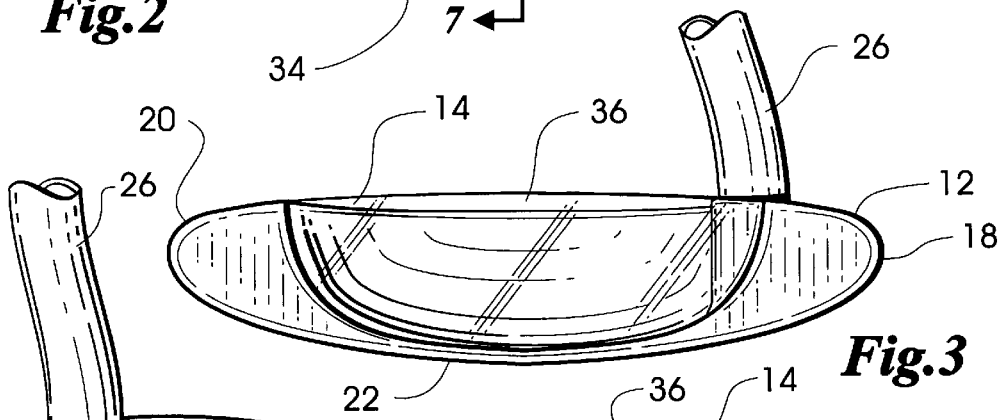
FIG. 3 is a front elevational view of the golf putter head of FIG. 1.
Figure 4:
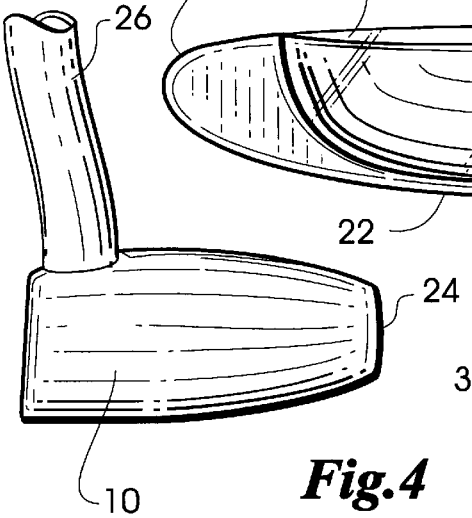
FIG. 4 is a heel end view of the golf putter head taken from the right in FIG. 3.
Figure 7:
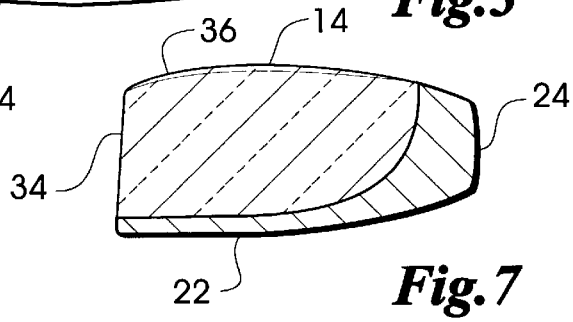
FIG. 7 is a sectional view taken along lines 7—7 in FIG. 2.
Figure 5:
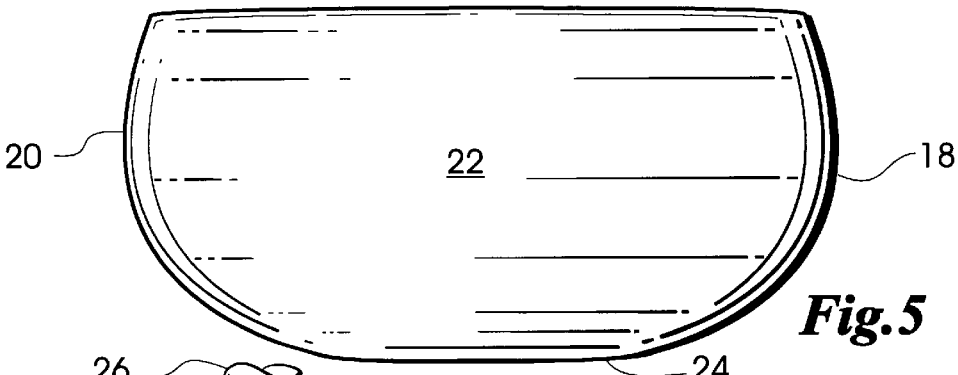
FIG. 5 is a bottom view of the golf putter head of FIG. 1.
Figure 6:
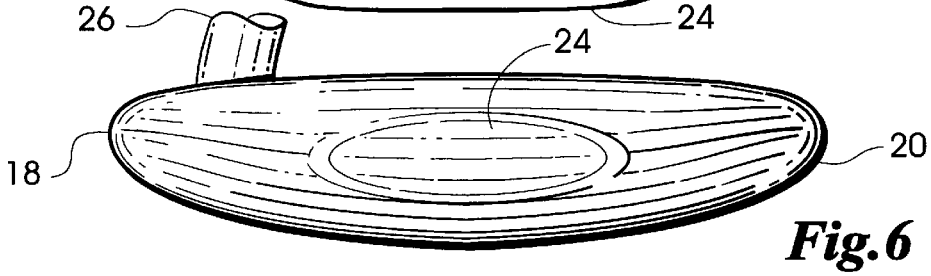
FIG. 6 is a rear elevational view of the golf putter head of FIG. 1.

As seen in FIGS. 2 and 3, the heel end portion 18, the toe end portion 20, the bottom portion 20 and the back portion 22 of the body 12 define a generally horseshoe shaped mass that partially surrounds the insert 14. This horseshoe shaped mass provides the putter head 10 with increased perimeter weighting due to the relationship between the relative densities of the body 12 and the insert 14.

A front face 34 on the insert 14 is arranged for impact with a golf ball, and a top surface 36 on the insert 14 may include alignment lines or marks (not shown) for properly aligning the putter head 10. Alternatively, the insert 14 may be transparent so that alignment lines or marks (also not shown) on the bottom portion 22 of the body 12 are visible when viewing the putter head 10 as shown in FIG. 2.

In the preferred embodiment of the putter head 10, the body 12 weighs 280 grams and the insert 14 weighs 50 grams for a total weight of 330 grams. The body 12 has a volume of 2.5 cubic inches, and the insert 14 has a volume of 2.9 cubic inches for a total volume of 5.4 cubic inches. Therefore, the insert 14 constitutes only about 15% of the total weight of the putter head 10 while constituting about 54% of the total volume of the putter head 10. This weight and volume relationship between the body 12 and the insert 14 provides the putter head 10 with increased perimeter weighting. Furthermore, since the body end portions 18 and 20 are relatively heavy compared with the insert 14, the putter head 10 has a high moment of inertia which will resist twisting of the putter head 10 when impacting a golf ball on the front face 34.

What is claimed is:

1. A golf putter head comprising:

a body formed of a first material having a first density, said body having a cavity formed therein, said body having a volume and a weight;

an insert disposed in said cavity in said body, said insert being formed of a second material having a second density that is substantially lower than said first density;

said insert having a volume that is greater than the volume of said body and a weight that is less than the weight of said body;

said body including a thickened heel end portion, a thickened toe end portion, a thin walled bottom portion and a thin walled back portion which define in combination a generally horseshoe shaped mass partially surrounding said insert; and said body heel end portion further including a boss projecting therefrom into said cavity in a direction toward said toe end portion, and a bore being located in said boss for receiving a lower end of a shaft.

2. The golf putter head of claim 1, wherein said insert has a front face arranged for impact with a golf ball.

3. The golf putter head of claim 1, wherein said second density is 6.5 to 8.5 times lower than said first density.

4. The golf putter head of claim 1, wherein said first material is a metal, and wherein said second material is an elastomer.

5. The golf putter head of claim 1, and wherein said insert comprises a recess for receiving said boss.

6. The golf putter head of claim 1, wherein said second material is polyurethane with a Shore D hardness of 65.

7. The golf putter head of claim 1, wherein:

said body and said insert together have a total volume and a total weight;

the volume of said insert is more than 50% of said total volume; and the weight of said insert is less than 50% of said total weight.

* * * * *